United States Patent [19]

Takagi

[11] Patent Number: 4,752,662

[45] Date of Patent: Jun. 21, 1988

[54] TURNTABLE DRIVING SYSTEM OF MICROWAVE OVEN

[75] Inventor: Yutaka Takagi, Nara, Japan

[73] Assignee: Sharp Kabushiki Kaisha, Osaka, Japan

[21] Appl. No.: 21,705

[22] Filed: Mar. 4, 1987

[30] Foreign Application Priority Data

Mar. 6, 1986 [JP] Japan ..... 61-32492[U]

[51] Int. Cl.[4] ..... H05B 6/78

[52] U.S. Cl. ..... 219/10.55 F; 219/10.55 E; 126/338; 99/443 R

[58] Field of Search ..... 219/10.55 F, 10.55 E, 219/10.55 R; 108/20; 126/338; 99/443 R, DIG. 14

[56] References Cited

U.S. PATENT DOCUMENTS

| | | | |
|---|---|---|---|
| 4,424,431 | 1/1984 | Gurubatham | 219/10.55 F |
| 4,631,379 | 12/1986 | Aoyama | 219/10.55 F |

FOREIGN PATENT DOCUMENTS

| | | | |
|---|---|---|---|
| 2618603 | 6/1978 | Fed. Rep. of Germany . | |
| 52-33145 | 3/1977 | Japan | 219/10.55 F |
| 2122060 | 1/1984 | United Kingdom | 219/10.55 F |

*Primary Examiner*—Philip H. Leung

*Attorney, Agent, or Firm*—Birch, Stewart, Kolasch & Birch

[57] ABSTRACT

A turntable driving system of a microwave oven comprises a turntable driving motor mounted in the microwave oven body, a turntable roller unit driven by the turntable driving motor to rotate a turntable, and a coupling for transmitting the output from the turntable driving motor to the turntable roller unit. The turntable roller unit comprises at least three rollers which are placed between the turntable and the oven chamber inner bottom wall at positions near the turntable peripheral edge so as to support the turntable virtually horizontally, wire metal rods in the same quantity as the rollers, extending radially from the position corresponding to the turntable bottom center toward the turntable peripheral edge and rotatably supporting the rollers, and a concaved cap mounted in the radial center of the metal rods so as to cover the coupling from the upper side for engagement with the circumferential wall of the coupling. Each of the metal rods is either bent or straight so that the actual length from the radial center to the end of the metal rod is equal to the distance from the turntable bottom center to a point between the turntable peripheral edge and the oven chamber inner side wall so that the actual length of the metal rod exceeds the radius of the turntable.

3 Claims, 3 Drawing Sheets

TURNTABLE DRIVING SYSTEM OF MICROWAVE OVEN

BACKGROUND OF THE INVENTION

The present invention relates to a turntable driving system of a microwave oven, or more specifically to a turntable driving system of low cost and high thermal resistance and having discharge preventive effect.

The conventional turntable driving system of this kind has a construction as shown in FIGS. 6 through 8 for example, in which rotation of the motor shaft (2) of a turntable driving motor (1) is transmitted through a coupling (3) provided on the end of the motor shaft (2) to a turntable roller unit (5) which in turn rotates a turntable (4) supported virtually horizontally by the turntable roller unit (5). As shown in FIG. 5, the turntable roller unit (5) comprises three rollers (8) positioned between the turntable (4) and the inner bottom wall of the oven chamber (7) of the microwave oven body (6), three projections (9) extending radially from the position corresponding to the center bottom of the turntable (4) toward the peripheral edge thereof so as to rotatably support the respective three rollers (8), and a cap (10) concaved downwardly which is provided in the center of the radially extending projections (9) and which is engageable with the coupling (3). The projections (9) and the cap (10) are one integral mold of synthetic resin.

When the above conventional turntable driving system is to be used in a microwave oven with a heater, the projection (9) and the cap (10) of the turntable roller unit (5) must be made of synthetic resin of high thermal resistance because of high temperature in the oven chamber (7) when the oven is operated. However, the thermal resistance of synthetic resin has a limit. Besides, the turntable roller unit (5) using synthetic resin of high thermal resistance incurs high cost.

SUMMARY OF THE INVENTION

To overcome the above problems, an object of the present invention is to provide a turntable driving system of low cost and high thermal resistance and having a preventive effect relative to beat generation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, according to an embodiment of the present invention, a microwave oven turntable driving system comprises a turntable driving motor mounted in the microwave oven body, a turntable roller unit driven by the motor to rotate a turntable, and a coupling for transmitting the output of the driving shaft of the motor to the turntable roller unit. The turntable roller unit comprises at least three rollers positioned between the turntable and the inner bottom wall of the oven chamber in the microwave oven body at positions, near the peripheral edge of the turntable, to support the turntable virtually horizontally, metal wire rods in the same number as the rollers, extending from the position corresponding to the bottom center of the turntable radially toward the peripheral edge of the turntable and rotatably supporting the respective rollers, and a concaved cap mounted in the center of the radially extending metal rods so as to be engaged with the coupling by covering the top and circumferential wall of the coupling. Each of the metal rods may be bent or straight, provided that the actual length from the radial center to the end of the metal rod is equal to the distance from the turntable bottom center to a point between the turntable peripheral edge and the inner side wall of the oven chamber so that the actual length of the metal rod exceeds the radius of the turntable.

The coupling may be of triangular or polygonal shape and is mounted approximately horizontally on the end of the motor shaft projecting into the inner bottom wall of the oven chamber at the position facing the turntable center bottom.

Thus, according to the present invention, the turntable driving motor, when run, rotates the turntable roller unit through the motor shaft and the coupling, thereby rotating the turntable.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 6:
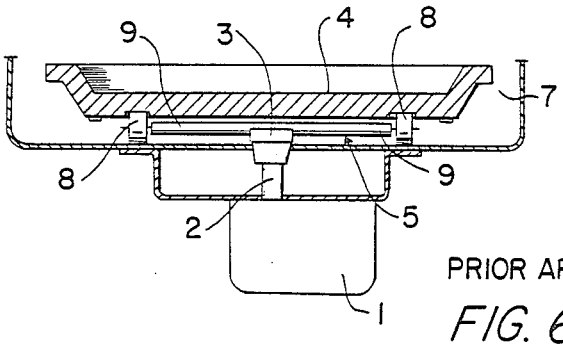
PRIOR ART FIG. 6
FIG. 6 is a sectional view of a turntable driving system with the conventional turntable roller unit, for explanatory purpose.
Figure 8:
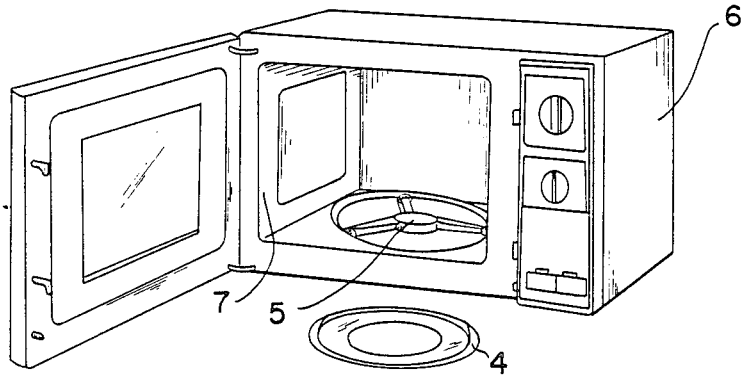
PRIOR ART FIG. 8
FIG. 8 is a perspective view of a microwave oven having the turntable driving system with the conventional turntable roller unit as shown in FIG. 5.

The construction of a cooking appliance or a heating appliance such as a microwave oven which is related to the turntable driving system of the present invention is basically the same as that shown in FIGS. 6 and 8. In the following description of the present invention, parts common to the oven with the conventional turntable driving system are allotted with the same reference numbers as in FIGS. 6 and 8, and their description is omitted.

The turntable driving system of the present invention rotates a turntable by the following mechanism. When a turntable driving motor (1) is run, the motor shaft (2) of the motor (1) rotates. The rotation is transmitted through a horizontal, say, triangular coupling (3') mounted on the end of the motor shaft (2) to a turntable roller unit (11) to turn the same, thereby rotating the turntable (4) supported virtually horizontally by the turntable roller unit (11).

The turntable roller unit (11) comprises at least three rollers (8') positioned between the turntable (4) and the inner bottom wall of the oven chamber (7) in the microwave oven body (6) as shown in FIG. 6, at least three projections (12) extending radially from the position corresponding to the bottom center of the turntable (4) toward the peripheral edge of the turntable (4) and rotatably supporting the rollers (8'), and a cap (13) concaved downwardly which is provided in the center of the radially extending projections (12) so as to be engaged with the coupling (3').

The primary characteristics of the present invention are that the projections (12) and the engaging cap (13) are made of metal and that the coupling (3') has a groove (14) in the top surface for engagement with the projections (12).

Figure 1:
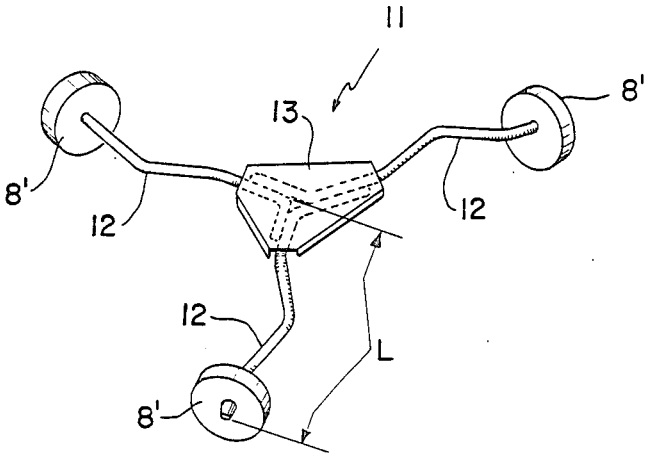
FIG. 1 is a perspective view of an embodiment of a turntable roller unit of the present invention.
Figure 2:
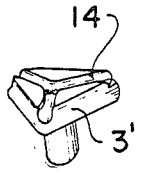
FIG. 2 is a perspective view of a coupling used in the present invention.

Each of the projections (12) is composed of metal wire rod which is bent into "⊔"-shape as shown in FIG. 1. At least three rollers (8) are rotatably supported by the metal projection rods (12). The metal rods (12) are fixed to one another by three-point spot welding at around their radial center. The actual length (L) measured from the radial center to the end of each metal rod (12) is set equal to the distance from the bottom center of the turntable (4) to a point between the peripheral edge of the turntable (4) and the inner side wall of the oven chamber (7) so that the actual length of the metal rod exceeds the radius of the turntable. The engaging cap (13) has a recess in the bottom surface and is approximately triangular when viewed from the top. The cap (13) is fixed by welding onto the weld joint of the metal rods (12) so that it covers the coupling (3') from the upper side for engagement with the circumferential wall of the coupling (13'). The groove (14) in the coupling (3') is radial as shown in FIG. 2 so that it fits on the weld joint of the metal rods (12).

For fabrication, the metal rods (12) of the turntable roller unit (11) are fit into the groove (14) of the coupling (3'), and the cap (13) placed on the coupling (3'). Finally the turntable (4) is placed on the turntable roller unit (11). When the turntable driving motor (1) is actuated, the turntable (4) rotates as the turntable roller unit (11) turns.

The present invention has the following advantageous effects:

(a) Thermal resistance of the turntable roller unit (11) is high because of the wire metal rods.

(b) Since the metal rods (12) are assembled in a radial form simply by three-point spot welding, manufacturing process is easy and incurs lower cost. Consequently, the turntable roller unit (11) itself is simple in construction and low in cost.

(c) When the turntable (4) is rotated with an excessively large load (food) thereon, the wire-like metal rods (12) bow, which prevents the moment of the load from being transmitted directly to the turntable driving motor (1). Accordingly, excessive current flow in the motor (1) and broken teeth on the reduction gear, which could occur at the time of starting the motor (1), are prevented.

(d) The engaging cap (13) provided on the turntable roller unit (11) covers the coupling (3'), protecting the coupling (3') against microwave. This prevents the temperature at the top of the coupling (3') from rising. Therefore, it is not necessary to select material of particularly good thermal resistance for manufacturing the coupling (3').

(e) When food on the turntable (4) is light in weight, the turntable (4) rotating on the turntable roller unit (11) may be lifted, causing the turntable roller unit (11) to come out of engagement with the groove (14) of the coupling (3'). However, the cap (13) of the turntable roller unit (11), which is engaged with the coupling (3'), prevents the turntable roller unit (11) from coming off the coupling (3'), thus ensuring stable rotation of the turntable (4). Therefore, the turntable (4) always rotates stably irrespective of the weight of food on the turntable (4).

Figure 4:
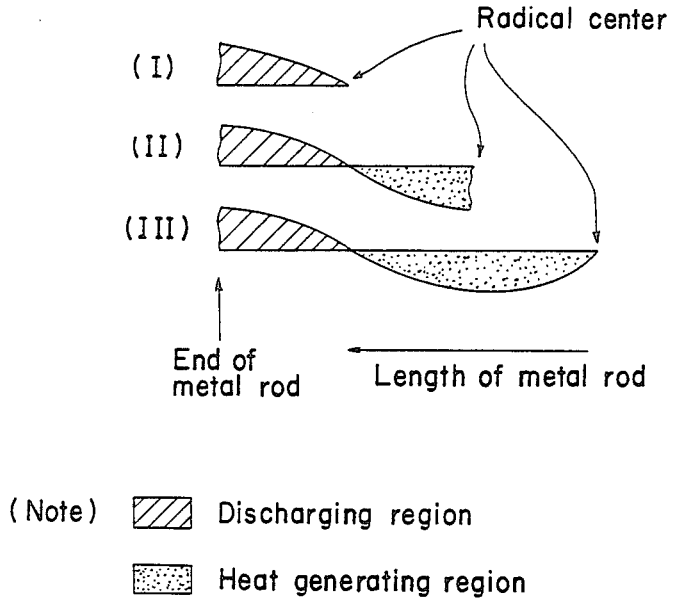
FIG. 4 is a graph showing the heat generation characteristic in the microwave electric field of the present invention, in comparison with those of other examples.
Figure 5:
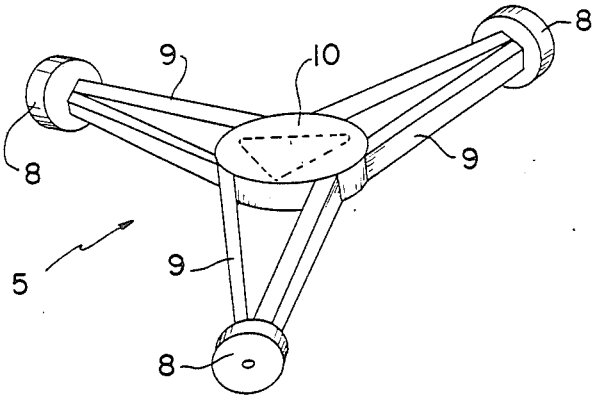
FIG. 5 PRIOR ART
FIG. 5 is a perspective view of the conventional turntable roller unit.
Figure 7:
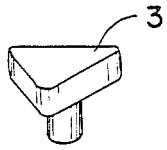
PRIOR ART FIG. 7
FIG. 7 is a perspective view of the conventional coupling.

(f) Experiments have verified that with the actual length (L) of each metal rod (12) being set as described above, little heat is generated by a microwave electric field around the radial center of the metal rods (12). There is no need of anticipating that the coupling (3') will be softened or melted by heat; it is also not necessary to take thermal resistance into account in selecting material for the coupling (3'). This also results in material cost reduction of the coupling (3'). Moreover, the above heat generation preventive measure also helps prevent the bottom wall of the oven chamber (7) and the turntable (4) from being burnt by heat. FIG. 4 shows the experimental result data which verify the above effects of the present invention. Heat generation characteristic with the length of the metal rods set as described above is shown in (III) and those with shorter metal rods in (I) and (II). As understood from these data, heat is not generated by microwave electric field in the radial center of the metal rods when the length of the metal rods is set as described above. In FIG. 4, microwave length in (I) is about $\lambda/4$, that in (II) is about $2/4\lambda$, and that in (III) is about $\frac{3}{4}\lambda$.

The number of rollers (8') need not be limited to three as in the above embodiment of the present invention; it may be four or more. If the number of rollers (8') is increased, the number of metal rods (12) must be also increased accordingly. The shape of the coupling (3') is not limited to a triangle as in the above embodiment; it may be quadrilateral or pentagon. In such a case, the engaging cap (13) of the turntable roller unit (11) must be of quadrilateral or pentagon to conform to the coupling (3').

Figure 3:
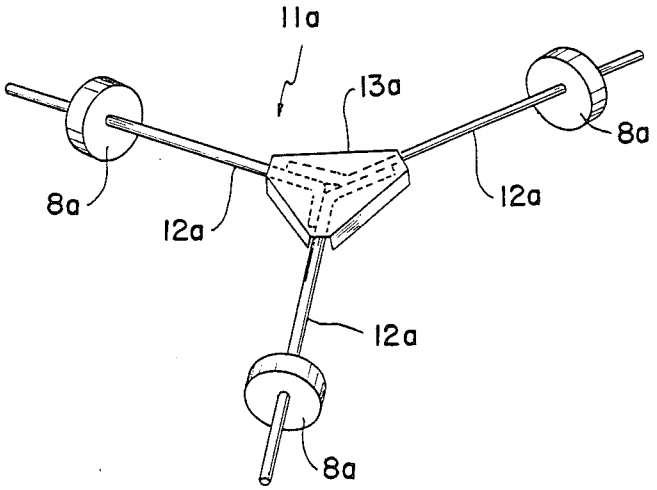
FIG. 3 is a perspective view of another embodiment of the present invention.

FIG. 3 is a perspective view of another embodiment of a turntable roller unit (11*a*). The turntable roller unit (11*a*) of this embodiment comprises straight metal rods (12*a*) and rollers (8*a*) rotatably mounted in the longitudinal midway of the respective metal rods (12*a*). The distance from the radial center of the metal rods (12*a*) to each of the rollers (8*a*) is set equal to the corresponding distance in a straight line in FIG. 1. The end of each metal rods (12*a*) projects from each roller (8*a*) toward the peripheral edge of the turntable (not shown). The length of each metal rod (12*a*) is the same as the actual length of each metal rod (12) of FIG. 1. Engaging cap (13*a*) of the second embodiment is identical with the engaging cap (13) of FIG. 1.

Like the first embodiment, the second embodiment of the invention can also prevent heat generation in the radial center of the metal rods (12*a*). For other effects as well, the second embodiment is the same as the first embodiment.

In brief, the present invention provides the following advantageous effects:

(a) Higher thermal resistance of the turntable roller unit (b) Low manufacturing cost and simple manufacturing process of the turntable roller unit (c) Prevention of excessive current flow in the turntable driving motor and of broken teeth on the motor power-transmitting reduction gear at the time of starting the motor (d) Material cost reduction of the coupling which does not require heat resistant material (e) Stabilized rotation of the turntable irrespective of the weight of food on the turntable.

(f) Prevention of heat generation by microwave electric field in the radial center of the metal rods.

While only certain embodiments of the present invention have been described, it will be apparent to those skilled in the art that various changes and modifications may be made therein without departing from the spirit and scope of the present invention as claimed.

What is claimed is:

1. A microwave oven comprising:

a heating chamber, having an inner side wall, in which an object that is to be heated can be disposed, said heating chamber having a bottom plate, turntable means for supporting the object to be heated, said turntable means arranged to rotate above an upper surface of said bottom plate of said heating chamber and having a center of rotation, a radius and a peripheral edge, a roller unit means for transmitting rotational power from a motor to said turntable means, said roller unit means including metal rods integrally connected together with a roller provided on each metal rod, said metal rods extending generally radially from said center, and the actual length of each said metal rod from said center of said turntable means to the end of said metal rod being equal to the distance from said center to a point between said turntable peripheral edge and said inner side wall of said heating chamber so that the actual length of each said metal rod exceeds said radius of said turntable means.

2. The microwave oven of claim 1 wherein each said metal rod is straight.

3. The microwave oven of claim 1 wherein each said metal rod is bent.

* * * * *